US011026037B2

(12) United States Patent
Sridharan et al.

(10) Patent No.: US 11,026,037 B2
(45) Date of Patent: Jun. 1, 2021

(54) SPATIAL-BASED AUDIO OBJECT GENERATION USING IMAGE INFORMATION

(71) Applicant: International Business Machines Corporation, Armonk, NY (US)

(72) Inventors: Srihari Sridharan, Nairobi (KE); Isaac Markus Serfaty, Miami, FL (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 16/515,158

(22) Filed: Jul. 18, 2019

(65) Prior Publication Data

US 2021/0021949 A1 Jan. 21, 2021

(51) Int. Cl.

| | |
|---|---|
| ***H04S 7/00*** | (2006.01) |
| ***H04S 5/02*** | (2006.01) |
| ***H04R 5/04*** | (2006.01) |

(52) U.S. Cl.

CPC ..... *H04S 7/30* (2013.01); *H04R 5/04* (2013.01); *H04S 5/02* (2013.01); *H04S 2400/01* (2013.01); *H04S 2420/01* (2013.01)

(58) Field of Classification Search

CPC . G10L 19/008; G10L 19/167; G10L 19/0204; G10L 19/20; H04S 3/008; H04S 2400/11

USPC ..... 381/22, 306, 310

See application file for complete search history.

(56) References Cited

U.S. PATENT DOCUMENTS

| | | | | |
|---|---|---|---|---|
| 5,870,480 | A | 2/1999 | Griesinger | |
| 7,692,685 | B2 * | 4/2010 | Beal | G06K 9/0057 348/169 |
| 8,335,330 | B2 | 12/2012 | Usher | |
| 9,332,373 | B2 | 5/2016 | Beaton et al. | |
| 10,034,113 | B2 * | 7/2018 | Kraemer | H04S 7/30 |
| 2014/0063061 | A1 * | 3/2014 | Reitan | G09G 3/003 345/633 |
| 2018/0206057 | A1 * | 7/2018 | Kim | H04S 7/304 |
| 2018/0295463 | A1 * | 10/2018 | Eronen | H04R 1/406 |

OTHER PUBLICATIONS

Aviv Gabbay et al., 'AVisual Speech Enhancement', Jun. 13, 2018, pp. 1-5, https://arxiv.org/.

Redmon J, Divvala S, Girshick R, Farhadi A. You only look once: Unified, real-time object detection. In Proceedings of the IEEE conference on computer vision and pattern recognition 2016 (pp. 779-788).

Ambiophonics—Wikipedia, https://en.wikipedia.org/wiki/Ambiophonics Apr. 13, 2019 4 pages.

(Continued)

*Primary Examiner* — Alexander Krzystan

(74) *Attorney, Agent, or Firm* — Shimon Benjamin; Otterstedt, Wallace & Kammer, LLP

(57) ABSTRACT

Methods and systems for generating a multichannel audio object. One or more features in a given video frame are identified using one or more image analysis neural networks. A multichannel audio object is generated based on the one or more identified features and one or more baseline audio tracks using an audio neural network.

17 Claims, 6 Drawing Sheets

(56) References Cited

OTHER PUBLICATIONS

Computing, cognitionand the future of knowingHow humans and machines are forginga new age of understandingDr. John E. Kelly IIISenior Vice President,IBM Research, IBM 2015 pp. 1-11, cover, endsheet.
Chun CJ, Kim YG, Yang JY, Kim HK Real-time conversion of stereo audio to 5.1 channel audio for providing realistic sounds. International Journal of Signal processing, Image processing and Pattern recognition. Dec. 2009;2(4):85-94.
Dolby Atmos, https://www.dolby.com/us/en/brands/dolby-atmos.html, Jul. 18, 2019, 9 pages.

* cited by examiner

SPATIAL-BASED AUDIO OBJECT GENERATION USING IMAGE INFORMATION

BACKGROUND

The present invention relates to the electrical, electronic and computer arts, and more specifically, to generating a spatial-based audio object.

Movies in digital format, until the recent past, typically included a video with a varying number of audio channels (audio tracks). Some of the earlier audio tracks included monophonic audio (one channel) and, later, stereophonic audio (two channels: left and right). In recent years, audio systems have begun using multi-channel audio outputs (such as the 5.1, 7.1, and 9.1 formats, and the like) with sound delivery formats like Dolby Atmos (a product of Dolby Laboratories of San Francisco, Calif., USA) and Auro-3D® for more immersive experiences. With the advent of such immersive sound systems, methods were developed to virtually up-mix the traditional channel audio to more channels (such as up-mixing from stereo audio to the 5.1 format). These methods, however, perform signal processing techniques on the audio signal directly and compute the inter-channel coherence to obtain virtual spatial coordinates of audio. Conventional methods employ signal processing techniques like phase shifting, time delay, or reverberation of audio on the audio track to compute inter-channel coherence for obtaining virtual spatial coordinates of the source of the audio. This is further utilized to isolate audio between channels.

SUMMARY

Principles of the invention provide techniques for the generation of spatial-based audio objects using image information. In one aspect, an exemplary method includes the operations of identifying one or more features in a given video frame using one or more image analysis neural networks; and generating a multichannel audio object based on the one or more identified features and one or more baseline audio tracks using an audio neural network.

In one aspect, an apparatus comprises a memory; and at least one processor, coupled to said memory, and operative to perform operations comprising: identifying one or more features in a given video frame using one or more image analysis neural networks; and generating a multichannel audio object based on the one or more identified features and one or more baseline audio tracks using an audio neural network.

In one aspect, a non-transitory computer readable medium comprises computer executable instructions which when executed by a computer cause the computer to perform the operations comprising: identifying one or more features in a given video frame using one or more image analysis neural networks; and generating a multichannel audio object based on the one or more identified features and one or more baseline audio tracks using an audio neural network.

As used herein, "facilitating" an action includes performing the action, making the action easier, helping to carry the action out, or causing the action to be performed. Thus, by way of example and not limitation, instructions executing on one processor might facilitate an action carried out by instructions executing on a remote processor, by sending appropriate data or commands to cause or aid the action to be performed. For the avoidance of doubt, where an actor facilitates an action by other than performing the action, the action is nevertheless performed by some entity or combination of entities.

One or more embodiments of the invention or elements thereof can be implemented in the form of a computer program product including a computer readable storage medium with computer usable program code for performing the method steps indicated. Furthermore, one or more embodiments of the invention or elements thereof can be implemented in the form of a system (or apparatus) including a memory, and at least one processor that is coupled to the memory and operative to perform exemplary method steps. Yet further, in another aspect, one or more embodiments of the invention or elements thereof can be implemented in the form of means for carrying out one or more of the method steps described herein; the means can include (i) hardware module(s), (ii) software module(s) stored in a computer readable storage medium (or multiple such media) and implemented on a hardware processor, or (iii) a combination of (i) and (ii); any of (i)-(iii) implement the specific techniques set forth herein.

Techniques of the present invention can provide substantial beneficial technical effects. For example, one or more embodiments provide one or more of:

audio object generation based on image and video information;

a model-based, up-mixing process that considers spatial features from the image, dynamic features from the image, or both, to generate multi-channel audio;

neural network that learns an optimal algorithm for generating the multi-channel audio; and scalable to any number of audio channels.

These and other features and advantages of the present invention will become apparent from the following detailed description of illustrative embodiments thereof, which is to be read in connection with the accompanying drawings.

DETAILED DESCRIPTION

Figure 1:
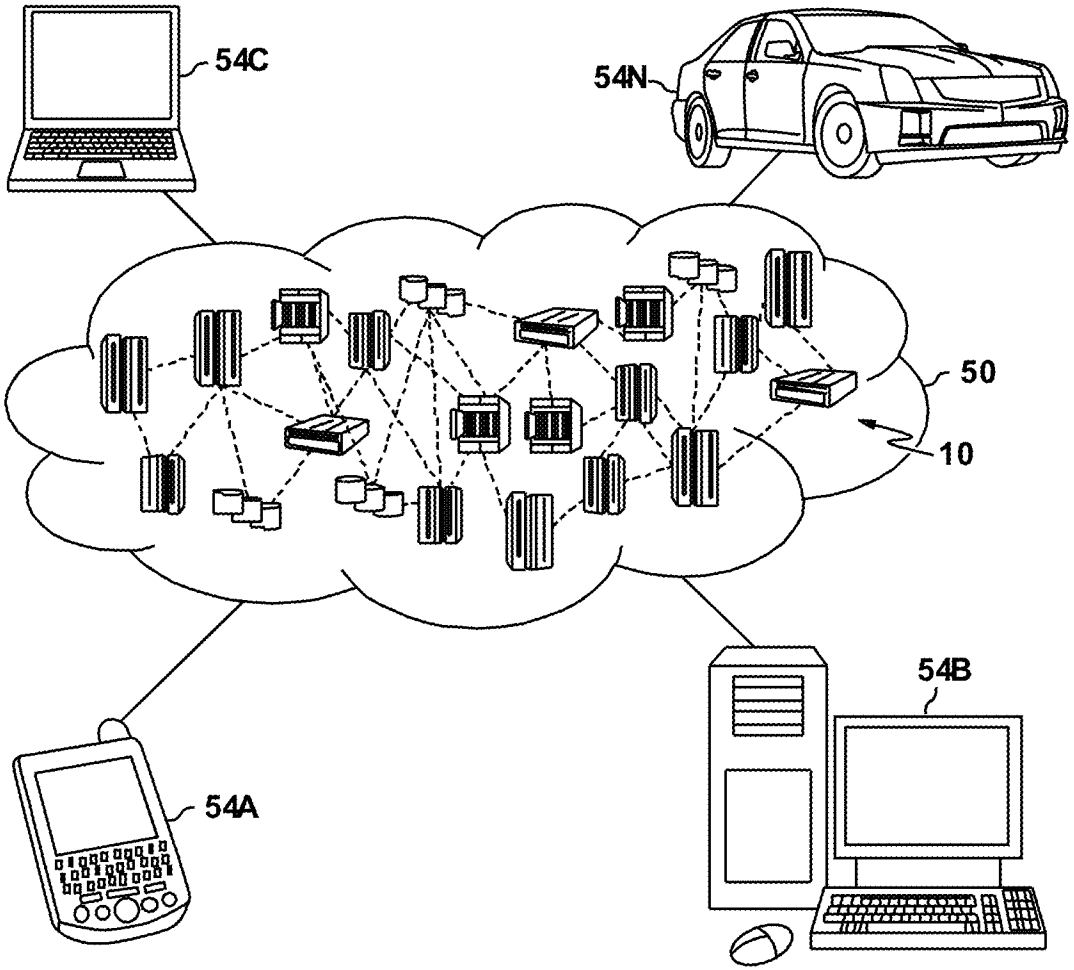
FIG. 1 depicts a cloud computing environment according to an embodiment of the present invention.

It is to be understood that although this disclosure includes a detailed description on cloud computing, implementation of the teachings recited herein are not limited to a cloud computing environment. Rather, embodiments of the present invention are capable of being implemented in conjunction with any other type of computing environment now known or later developed.

Cloud computing is a model of service delivery for enabling convenient, on-demand network access to a shared pool of configurable computing resources (e.g., networks, network bandwidth, servers, processing, memory, storage, applications, virtual machines, and services) that can be rapidly provisioned and released with minimal management effort or interaction with a provider of the service. This cloud model may include at least five characteristics, at least three service models, and at least four deployment models.

Characteristics are as follows:

On-demand self-service: a cloud consumer can unilaterally provision computing capabilities, such as server time and network storage, as needed automatically without requiring human interaction with the service's provider.

Broad network access: capabilities are available over a network and accessed through standard mechanisms that promote use by heterogeneous thin or thick client platforms (e.g., mobile phones, laptops, and PDAs).

Resource pooling: the provider's computing resources are pooled to serve multiple consumers using a multi-tenant model, with different physical and virtual resources dynamically assigned and reassigned according to demand. There is a sense of location independence in that the consumer generally has no control or knowledge over the exact location of the provided resources but may be able to specify location at a higher level of abstraction (e.g., country, state, or datacenter).

Rapid elasticity: capabilities can be rapidly and elastically provisioned, in some cases automatically, to quickly scale out and rapidly released to quickly scale in. To the consumer, the capabilities available for provisioning often appear to be unlimited and can be purchased in any quantity at any time.

Measured service: cloud systems automatically control and optimize resource use by leveraging a metering capability at some level of abstraction appropriate to the type of service (e.g., storage, processing, bandwidth, and active user accounts). Resource usage can be monitored, controlled, and reported, providing transparency for both the provider and consumer of the utilized service.

Service Models are as follows:

Software as a Service (SaaS): the capability provided to the consumer is to use the provider's applications running on a cloud infrastructure. The applications are accessible from various client devices through a thin client interface such as a web browser (e.g., web-based e-mail). The consumer does not manage or control the underlying cloud infrastructure including network, servers, operating systems, storage, or even individual application capabilities, with the possible exception of limited user-specific application configuration settings.

Platform as a Service (PaaS): the capability provided to the consumer is to deploy onto the cloud infrastructure consumer-created or acquired applications created using programming languages and tools supported by the provider. The consumer does not manage or control the underlying cloud infrastructure including networks, servers, operating systems, or storage, but has control over the deployed applications and possibly application hosting environment configurations.

Infrastructure as a Service (IaaS): the capability provided to the consumer is to provision processing, storage, networks, and other fundamental computing resources where the consumer is able to deploy and run arbitrary software, which can include operating systems and applications. The consumer does not manage or control the underlying cloud infrastructure but has control over operating systems, storage, deployed applications, and possibly limited control of select networking components (e.g., host firewalls).

Deployment Models are as follows:

Private cloud: the cloud infrastructure is operated solely for an organization. It may be managed by the organization or a third party and may exist on-premises or off-premises.

Community cloud: the cloud infrastructure is shared by several organizations and supports a specific community that has shared concerns (e.g., mission, security requirements, policy, and compliance considerations). It may be managed by the organizations or a third party and may exist on-premises or off-premises.

Public cloud: the cloud infrastructure is made available to the general public or a large industry group and is owned by an organization selling cloud services.

Hybrid cloud: the cloud infrastructure is a composition of two or more clouds (private, community, or public) that remain unique entities but are bound together by standardized or proprietary technology that enables data and application portability (e.g., cloud bursting for load-balancing between clouds).

A cloud computing environment is service oriented with a focus on statelessness, low coupling, modularity, and semantic interoperability. At the heart of cloud computing is an infrastructure that includes a network of interconnected nodes.

Referring now to FIG. 1, illustrative cloud computing environment 50 is depicted. As shown, cloud computing environment 50 includes one or more cloud computing nodes 10 with which local computing devices used by cloud consumers, such as, for example, personal digital assistant (PDA) or cellular telephone 54A, desktop computer 54B, laptop computer 54C, and/or automobile computer system 54N may communicate. Nodes 10 may communicate with one another. They may be grouped (not shown) physically or virtually, in one or more networks, such as Private, Community, Public, or Hybrid clouds as described hereinabove, or a combination thereof. This allows cloud computing environment 50 to offer infrastructure, platforms and/or software as services for which a cloud consumer does not need to maintain resources on a local computing device. It is understood that the types of computing devices 54A-N shown in FIG. 1 are intended to be illustrative only and that computing nodes 10 and cloud computing environment 50 can communicate with any type of computerized device over any type of network and/or network addressable connection (e.g., using a web browser).

Figure 2:
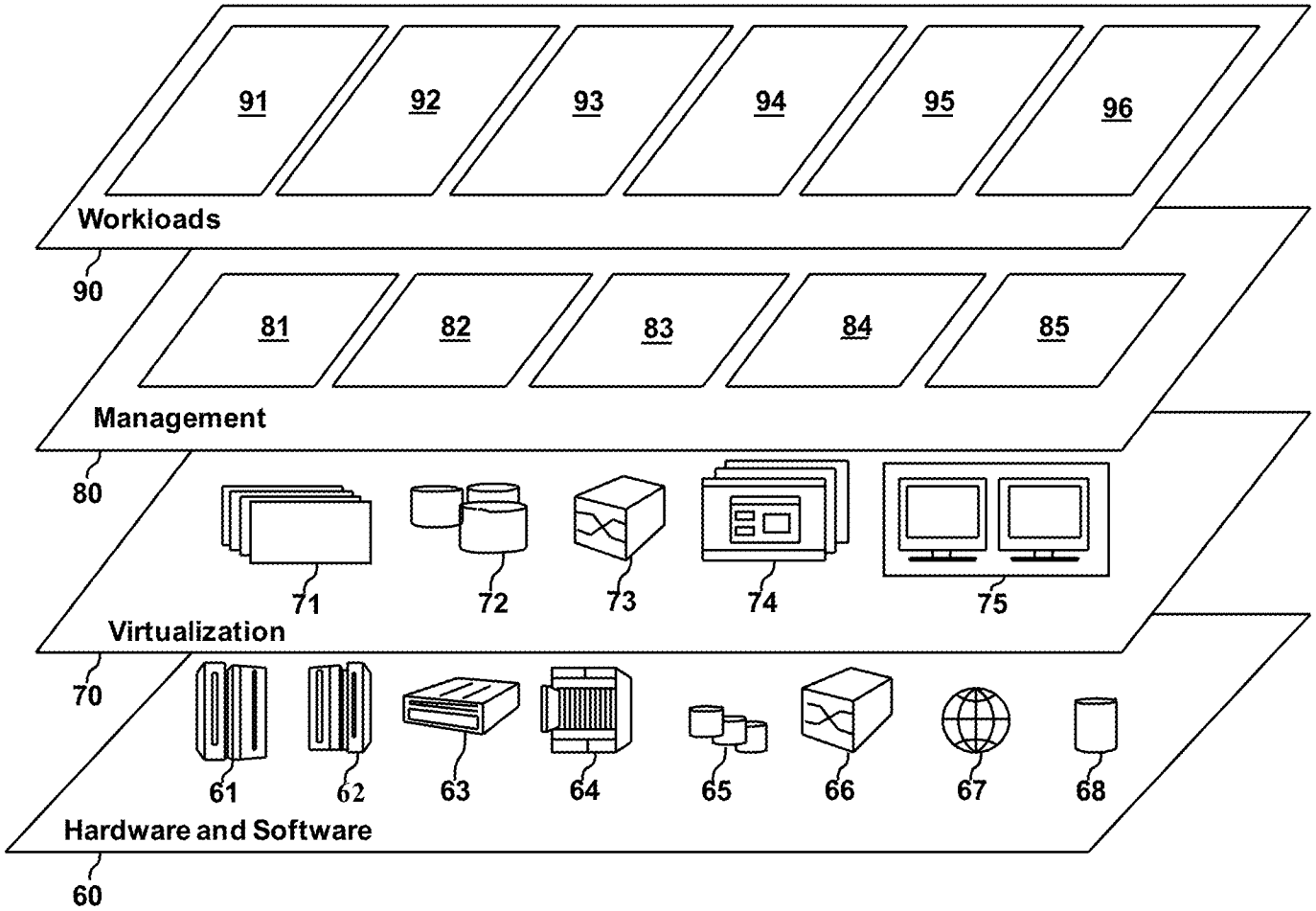
FIG. 2 depicts abstraction model layers according to an embodiment of the present invention.

Referring now to FIG. 2, a set of functional abstraction layers provided by cloud computing environment 50 (FIG. 1) is shown. It should be understood in advance that the components, layers, and functions shown in FIG. 2 are intended to be illustrative only and embodiments of the invention are not limited thereto. As depicted, the following layers and corresponding functions are provided:

Hardware and software layer 60 includes hardware and software components. Examples of hardware components include: mainframes 61; RISC (Reduced Instruction Set Computer) architecture based servers 62; servers 63; blade servers 64; storage devices 65; and networks and networking components 66. In some embodiments, software components include network application server software 67 and database software 68.

Virtualization layer 70 provides an abstraction layer from which the following examples of virtual entities may be provided: virtual servers 71; virtual storage 72; virtual networks 73, including virtual private networks; virtual applications and operating systems 74; and virtual clients 75.

In one example, management layer 80 may provide the functions described below. Resource provisioning 81 provides dynamic procurement of computing resources and other resources that are utilized to perform tasks within the cloud computing environment. Metering and Pricing 82 provide cost tracking as resources are utilized within the cloud computing environment, and billing or invoicing for consumption of these resources. In one example, these resources may include application software licenses. Security provides identity verification for cloud consumers and tasks, as well as protection for data and other resources. User portal 83 provides access to the cloud computing environment for consumers and system administrators. Service level management 84 provides cloud computing resource allocation and management such that required service levels are met. Service Level Agreement (SLA) planning and fulfillment 85 provide pre-arrangement for, and procurement of, cloud computing resources for which a future requirement is anticipated in accordance with an SLA.

Workloads layer 90 provides examples of functionality for which the cloud computing environment may be utilized. Examples of workloads and functions which may be provided from this layer include: mapping and navigation 91; software development and lifecycle management 92; virtual classroom education delivery 93; data analytics processing 94; transaction processing 95; and audio object generator 96.

Generally, methods and systems are disclosed for generating an audio object using image and video information. The audio object may be an audio channel or track (channel and track are used interchangeably herein), or a plurality of audio channels or tracks. In one example embodiment, object information and spatial information of a video, such as depth information for an object, is used to identify the spatial location(s) of the source(s) of audio signals and to generate an object-based multichannel audio. The generated audio channels may be used to provide, for example, ambience sound for a video. The process can be viewed as a model-based audio up-mixing using a single, end-to-end neural network.

In one example embodiment, a video track (a sequence of images) and one or more corresponding audio tracks are provided as input to a single, end-to-end neural network. The audio tracks include, for example, one or two channels, as in the case of monophonic or stereophonic audio, referred to as baseline audio tracks herein. (Baseline audio tracks of greater than two channels are also contemplated.) The output is a multidimensional array, where the number of dimensions is the number of output channels in the audio system (which can be selected as desired). For example, 128 simultaneous audio objects can be utilized with the Dolby Atmos system.

Within the end-to-end model, a first phase of the neural network operates on the video input to estimate and extract, for example, image features, such as an identification of objects in the video frame, depth information for the objects, and the like. The extracted image features are given as input to a second phase of the neural network. In the second phase, in essence, the features of objects that are the source of audio are used to determine which audio channel, and hence which speaker, a sound will emanate from. The second phase of the neural network operates on the input audio signal using the extracted video features to generate the audio object. The outputs of the entire neural network are the multiple channels of audio in formats such as "ambiophonics" audio, 5.1 audio, and the like.

In general, image information, such as depth and other spatial information, from the video is utilized to learn/isolate the spatial location of the sources of the audio signals. Frequencies, amplitudes, and time windows vary with the location of an object (inside the video frame). For example, a car moving across a video frame can exhibit a Doppler Effect (high to low to high frequency). An exploding bomb in the foreground of an image would have a larger frequency spectrum with higher amplitudes than other sources of sound.

Conventional methods of generating multi-channel audio include the adaptive panning method, low/high pass filters, and principal component analysis (PCA)-based up-mixing which decomposes the original stereo channels into correlated and uncorrelated portions. An audio signal with fewer channels can be perceived as data with fewer (missing) dimensions. Techniques such as matrix factorization on the audio signal may be used to isolate channel frequency. In one example embodiment, the model(s) of the neural network(s) are trained by using multiple instances of videos with baseline audio tracks (such as a 5.1 audio format down-mixed to stereo) as input, and the video's original multichannel track audio as the intended output. In one example embodiment, the first phase of the neural network is trained to determine the features of a video that are correlated to the relationship between the down-mixed audio and the original multichannel audio.

In one example embodiment, the first phase of the system is implemented using one or more pre-trained neural networks that each extract one or more types of features from an image and/or video. For example, a first pre-trained neural network can identify a type of object in a video frame, a second pre-trained neural network can identify the coordinates of the object in the video frame, and a third pre-trained neural network can identify the depth of the object in the video frame. In one example embodiment, the pre-trained neural networks jointly process the information to derive the various features and identifications. Moreover, in addition to neural networks, any other model that provides a "spatial representation" of image features in vector form can be used, for example, to identify a type of object in a video frame, identify the coordinates of the object in the video frame, and identify the depth of the object in the video frame.

The determined features (together with the baseline audio and the video's original multichannel track audio) are then used to train the second phase of the neural network to generate the multichannel audio output. Once trained, the multichannel audio output of a given video is then generated based on video frames of the given video and a relatively small number of audio channels of the given video (such as the baseline audio tracks).

The disclosed pipeline is analogous to a common deep learning problem known as visual question answering (VQA). It is also viable to isolate contextual correlations between datasets of different modalities in a single end-to-end model. In VQA, an attention mechanism is used to isolate elements in an image to reason in textual data. A similar attention mechanism is utilized, where the datasets comprise image and audio signals, as in the case of a movie scene. Attention is utilized to isolate frequencies and time windows, relevant to spatial components of an image.

During training, the input dataset includes the original multi-channel audio, baseline audio tracks (where the original multi-channel audio has been down-sampled to, for example, stereo or mono channels, or where an original version of the audio is available in, for example, stereo or mono channels), and a series of video frames from a library of training videos. This can include multiple short video snippets or movies in their entirety. The first phase of the neural network is pre-trained to extract features from the video frames, such as the identification of objects, the location and/or depth of the object, and the like. The second phase of the neural network is trained to utilize the extracted features from the video frames and the baseline audio tracks to generate the original multichannel audio. Once trained, the SAOGS will generate multichannel audio based on the video frames and a relatively small number of audio track(s) (such as the baseline audio tracks) of a given video. The output of the network can also be in the form of a format such as "ambiophonics" audio. This format includes four components namely, W: sound pressure, X: Front-Back sound pressure, Y: Left-Right sound pressure, and Z: Up-Down sound pressure. These outputs can further be operated on to generate per channel information. As described above, the use of stereo or mono channels is a non-limiting example. The system may be trained with greater than two audio channels and the system may generate a multichannel audio for a given video that has greater than two original audio channels.

Figure 3:
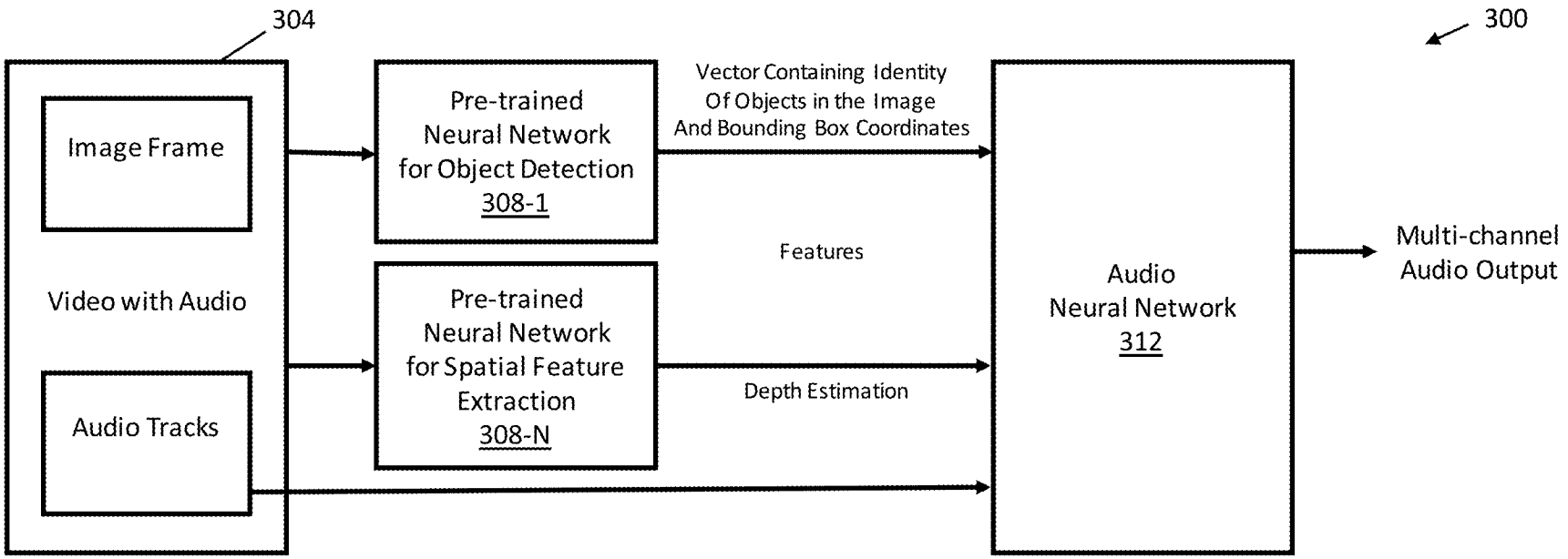
FIG. 3 is a block diagram of an example spatial-based audio object generation system (SAOGS), in accordance with an example embodiment.

FIG. 3 is a block diagram of an example spatial-based audio object generation system 300, in accordance with an example embodiment. A video 304 containing a sequence of video frames and one or more audio tracks is submitted to the SAOGS 300. The sequence of video frames, or a sampling of the sequence of video frames, is submitted to one or more image analysis neural networks 308-1, . . . 308-N (collectively referred to as image analysis neural networks 308 herein).

Generally, a neural network includes a plurality of computer processors that are configured to work together to implement one or more machine learning algorithms. The implementation may be synchronous or asynchronous. In a neural network, the processors simulate thousands or millions of neurons, which are connected by axons and synapses. Each connection is enforcing, inhibitory, or neutral in its effect on the activation state of connected neural units. Each individual neural unit has a summation function which combines the values of all its inputs together. In some implementations, there is a threshold function or limiting function on at least some connections and/or on at least some neural units, such that the signal must surpass the limit before propagating to other neurons. A neural network can implement supervised, unsupervised, or semi-supervised machine learning.

In one example embodiment, one video frame is extracted from each second of a given video and submitted to each of the image analysis neural networks 308. In one example embodiment, the first video frame to exhibit a substantial change from the previous image (as indicated, for example, by a histogram) may be submitted as the next frame to each of the image analysis neural networks 308. Example image analysis neural networks 308 include, but are not limited to, an image analysis neural network 308-1 for object detection, an image analysis neural network 308-N for spatial feature extraction (such as depth features), and the like. In one example embodiment, the image analysis neural networks 308 are pre-trained to identify the corresponding video features in each video frame.

In one example embodiment, the image analysis neural network 308-1 for object detection generates a vector containing the identification of objects in the video frame along with corresponding boundary box coordinates. In one example embodiment, the image analysis neural network 308-N for spatial feature extraction generates an alternate representation of the video frame with depth estimations. For example, depth information may be determined for each pixel in the image, for each object in the image, and the like.

In one example embodiment, the output(s) of the image analysis neural network(s) 308 are input to an audio neural network 312. During a training phase, the audio neural network 312 processes videos containing multi-channel audio, such as audio in the 5.1 channel format, and learns the relationship between image features and each audio channel. After training, based on the learned relationships, the audio neural network 312 generates the individual audio channels of a multi-channel audio output 316 for a given video using the original baseline audio tracks of the video and the frames of the video.

Figure 4A:
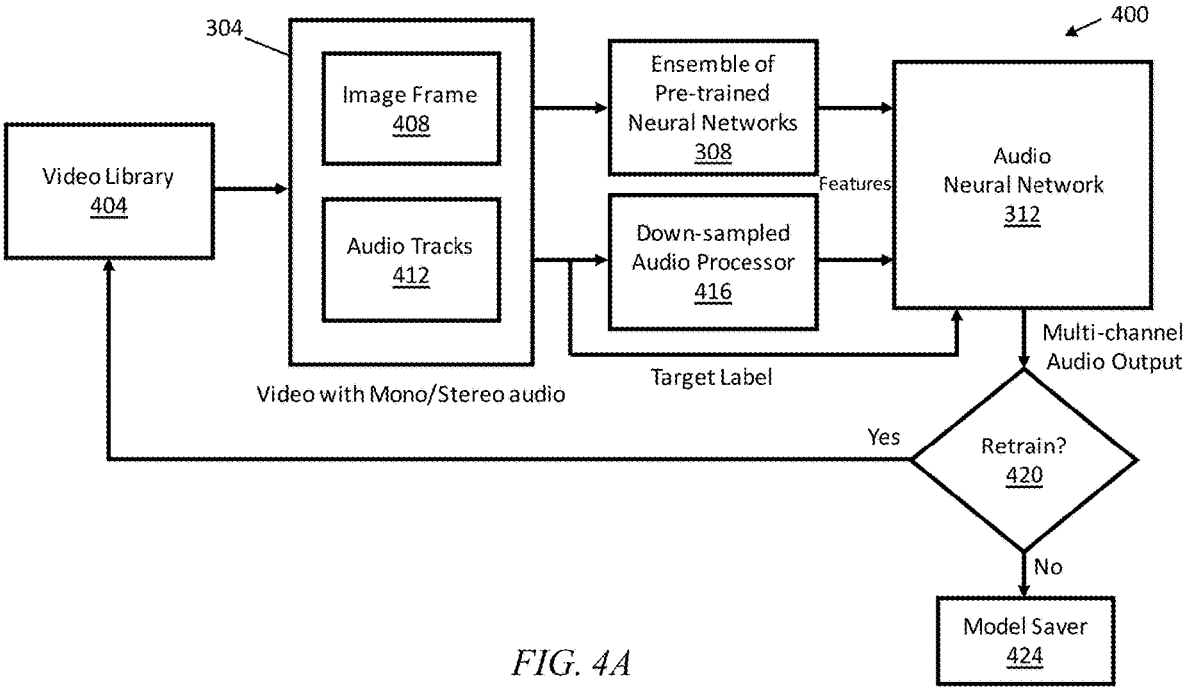
FIG. 4A is an example workflow for training an audio neural network, in accordance with an example embodiment.

FIG. 4A is an example workflow 400 for training the audio neural network 312, in accordance with an example embodiment. In one example embodiment, a video 304 is obtained from a video library 404. Each video 304 includes two or more image frames 408 and one or more audio tracks 412. The image frames 408 are processed by the ensemble of pre-trained image analysis neural networks 308 which extract the video features for processing by the audio neural network 312. If the video 304 contains only the multi-channel audio tracks (that is, not the baseline audio tracks), a down-sampled audio processor 416 generates the baseline audio tracks and provides them to the audio neural network 312. If the video 304 contains the baseline audio tracks, the baseline audio tracks are provided directly to the audio neural network 312. The audio neural network 312 then generates the multi-channel audio output (named with the target label provided for the multi-channel audio output) and a determination of whether the audio neural network 312 requires further training (retraining) is made (operation 420). If further training is required (YES branch of operation 420), another video 304 is obtained from the video library 404 and processed; otherwise (NO branch of operation 420), the model for the audio neural network 312 is stored by a model saver 424. In one example embodiment, the determination of whether further training is required is made by comparing the multi-channel audio output generated by the audio neural network 312 with the multi-channel audio of the training video 304. If the two multi-channel audios are sufficiently similar, further training is not required. In one example embodiment, a loss function, such as cross-entropy loss, mean square error loss (mean difference between square of predictions and targets), and the like, is used to determine if the multi-channel audios are sufficiently similar. In one example embodiment, a cumulative similarity score is determined by comparing the original and generated multi-channel audio tracks for a plurality of videos 304. In one example embodiment, the audio neural network 312 is periodically retrained using additional videos 304, as described above.

Figure 4B:
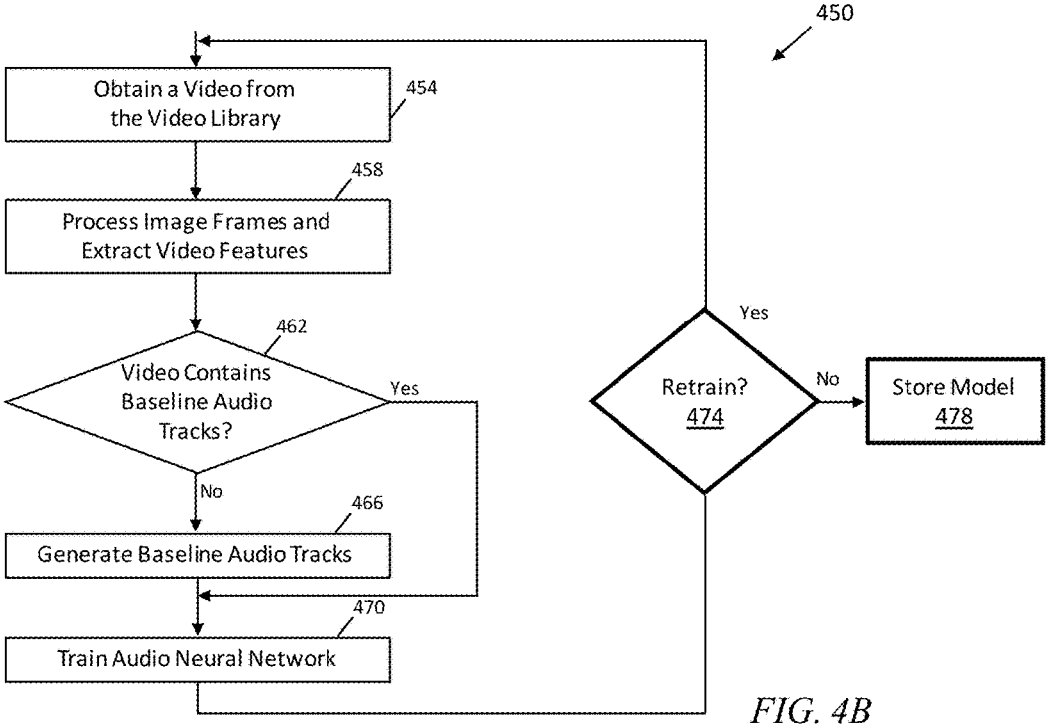
FIG. 4B is a flowchart for an example method for training the audio neural network, in accordance with an example embodiment.

FIG. 4B is a flowchart for an example method 450 for training the audio neural network 312, in accordance with an example embodiment. In one example embodiment, a video 304 is obtained from the video library 404 (operation 454). The image frames 408 are processed by the ensemble of pre-trained image analysis neural networks 308 which extract the video features for processing by the audio neural network 312 (operation 458). A check is performed to determine if the video 304 contains the baseline audio tracks (decision block 462). If the video 304 does not contain the baseline audio tracks (NO branch of decision block 462), the baseline audio tracks are generated from the multi-channel audio tracks (operation 466) and are provided to train the audio neural network 312; otherwise (YES branch of operation 462), the baseline audio tracks are obtained from the video library 404 and are provided to train the audio neural network 312. The audio neural network 312 is then trained using the extracted features, the baseline audio tracks, and the multi-channel audio tracks (operation 470).

In one example embodiment, a check is performed to determine if retraining is required (decision block 474). If further training is required (YES branch of operation 474), the method 450 proceeds with operation 454 and another video is obtained from the video library 404 and processed; otherwise (NO branch of operation 474), the model for the audio neural network 312 is stored by the model saver 424 (operation 478).

Figure 5A:
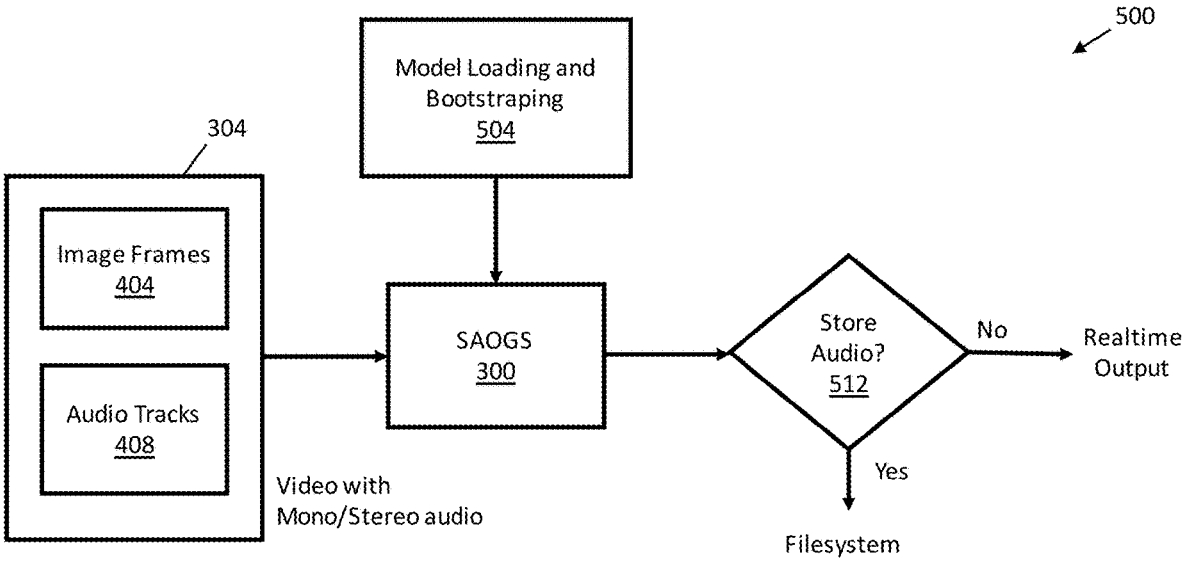
FIG. 5A is an example workflow for generating multi-channel audio using the SAOGS, in accordance with an example embodiment.

FIG. 5A is an example workflow 500 for generating multi-channel audio using the SAOGS 300, in accordance with an example embodiment. In one example embodiment, the ensemble of pre-trained image analysis neural networks 308 are loaded and bootstrapped with their corresponding models and the trained model for the audio neural network 312 is loaded and bootstrapped by the model loading and bootstrapping module 504. A video 304 is also obtained from the video library 404. The video 304 is processed by the pre-trained ensemble of image analysis neural networks 308 and the audio neural network 312 of the SAOGS 300. In one example embodiment, a check 512 is performed to determine if the multi-channel audio is being used online or stored for offline use. If the multi-channel audio is being used online (NO branch of decision block 512), the multi-channel audio is output; otherwise (YES branch of decision block 512), the multi-channel audio is stored.

Figure 5B:
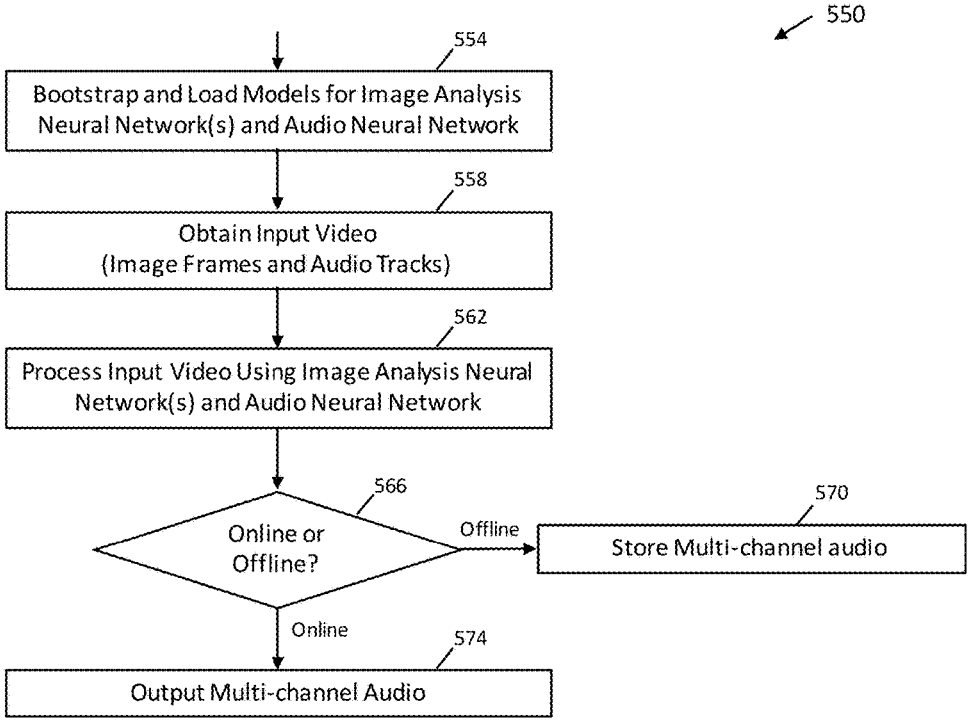
FIG. 5B is a flowchart for an example method for generating multi-channel audio using the SAOGS, in accordance with an example embodiment.

FIG. 5B is a flowchart for an example method 550 for generating multi-channel audio using the SAOGS 300, in accordance with an example embodiment. In one example embodiment, the ensemble of pre-trained image analysis neural networks 308 are bootstrapped and loaded with their corresponding models and the trained model for the audio neural network 312 is bootstrapped and loaded (operation 554). A video 304 is obtained from the video library 404 (operation 558) and is processed by the pre-trained ensemble of image analysis neural networks 308 and the audio neural network 312 of the SAOGS 300 (operation 562). In one example embodiment, a check is performed to determine if the multi-channel audio is being used online or stored for offline use (decision block 566). If the multi-channel audio is being used online (ONLINE branch of decision block 566), the multi-channel audio is output (operation 574); otherwise (OFFLINE branch of decision block 566), the model for the audio neural network 312 is stored by the model saver 424 (operation 570).

Given the discussion thus far, it will be appreciated that, in general terms, an exemplary method, according to an aspect of the invention, includes the operations of identifying one or more features in a given video frame using one or more image analysis neural networks 308 (operation 562); and generating a multichannel audio object based on the one or more identified features and one or more baseline audio tracks 412 using an audio neural network 312 (operation 562).

In one example embodiment, a synthetic audio object is generated during a transition from a first channel to a second channel using a generative model (operation 562). In one example embodiment, the generative model is one of a generative adversarial network and a variational autoencoder. In one example embodiment, each image analysis neural network 308 is trained based on one or more training video frames and one or more corresponding training features. In one example embodiment, the audio neural network 312 is trained based on one or more training features extracted from one or more training video frames, one or more corresponding multichannel audio tracks 412, and one or more baseline audio tracks 412 (operation 470). In one example embodiment, the multichannel audio tracks 412 are down-sampled to generate the baseline audio tracks 412. In one example embodiment, one or more objects in the given video frame are identified, the one or more identifications being provided as input to the audio neural network 312 (operation 562).

In one aspect, an apparatus comprises a memory; and at least one processor, coupled to said memory, and operative to perform operations comprising: identifying one or more features in a given video frame using one or more image analysis neural networks 308 (operation 562); and generating a multichannel audio object based on the one or more identified features and one or more baseline audio tracks 412 using an audio neural network 312 (operation 562).

In one aspect, a non-transitory computer readable medium comprises computer executable instructions which when executed by a computer cause the computer to perform the operations comprising: identifying one or more features in a given video frame using one or more image analysis neural networks 308 (operation 562); and generating a multichannel audio object based on the one or more identified features and one or more baseline audio tracks 412 using an audio neural network 312 (operation 562).

Figure 6:
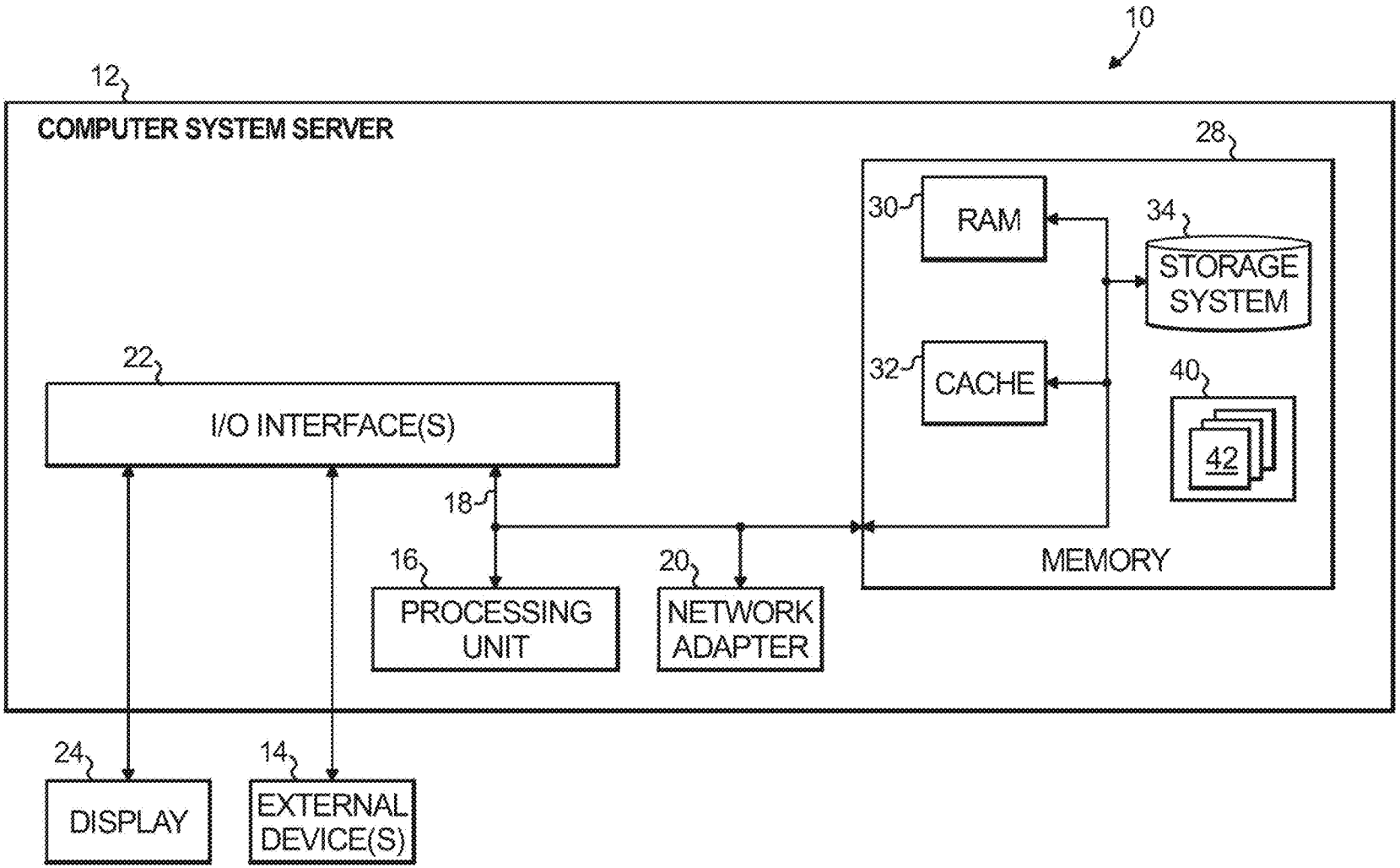
FIG. 6 depicts a computer system that may be useful in implementing one or more aspects and/or elements of the invention, also representative of a cloud computing node according to an embodiment of the present invention.

One or more embodiments of the invention, or elements thereof, can be implemented in the form of an apparatus including a memory and at least one processor that is coupled to the memory and operative to perform exemplary method steps. FIG. 6 depicts a computer system that may be useful in implementing one or more aspects and/or elements of the invention, also representative of a cloud computing node according to an embodiment of the present invention. Referring now to FIG. 6, cloud computing node 10 is only one example of a suitable cloud computing node and is not intended to suggest any limitation as to the scope of use or functionality of embodiments of the invention described herein. Regardless, cloud computing node 10 is capable of being implemented and/or performing any of the functionality set forth hereinabove.

In cloud computing node 10 there is a computer system/server 12, which is operational with numerous other general purpose or special purpose computing system environments or configurations. Examples of well-known computing systems, environments, and/or configurations that may be suitable for use with computer system/server 12 include, but are not limited to, personal computer systems, server computer systems, thin clients, thick clients, handheld or laptop devices, multiprocessor systems, microprocessor-based systems, set top boxes, programmable consumer electronics, network PCs, minicomputer systems, mainframe computer systems, and distributed cloud computing environments that include any of the above systems or devices, and the like.

Computer system/server 12 may be described in the general context of computer system executable instructions, such as program modules, being executed by a computer system. Generally, program modules may include routines, programs, objects, components, logic, data structures, and so on that perform particular tasks or implement particular abstract data types. Computer system/server 12 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 6, computer system/server 12 in cloud computing node 10 is shown in the form of a general-purpose computing device. The components of computer system/server 12 may include, but are not limited to, one or more processors or processing units 16, a system memory 28, and a bus 18 that couples various system components including system memory 28 to processor 16.

Bus 18 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

Computer system/server 12 typically includes a variety of computer system readable media. Such media may be any available media that is accessible by computer system/server 12, and it includes both volatile and non-volatile media, removable and non-removable media.

System memory 28 can include computer system readable media in the form of volatile memory, such as random access memory (RAM) 30 and/or cache memory 32. Computer system/server 12 may further include other removable/non-removable, volatile/non-volatile computer system storage media. By way of example only, storage system 34 can be provided for reading from and writing to a non-removable, non-volatile magnetic media (not shown and typically called a "hard drive"). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to bus 18 by one or more data media interfaces. As will be further depicted and described below, memory 28 may include at least one program product having a set (e.g., at least one) of program modules that are configured to carry out the functions of embodiments of the invention.

Program/utility 40, having a set (at least one) of program modules 42, may be stored in memory 28 by way of example, and not limitation, as well as an operating system, one or more application programs, other program modules, and program data. Each of the operating system, one or more application programs, other program modules, and program data or some combination thereof, may include an implementation of a networking environment. Program modules 42 generally carry out the functions and/or methodologies of embodiments of the invention as described herein.

Computer system/server 12 may also communicate with one or more external devices 14 such as a keyboard, a pointing device, a display 24, etc.; one or more devices that enable a user to interact with computer system/server 12; and/or any devices (e.g., network card, modem, etc.) that enable computer system/server 12 to communicate with one or more other computing devices. Such communication can occur via Input/Output (I/O) interfaces 22. Still yet, computer system/server 12 can communicate with one or more networks such as a local area network (LAN), a general wide area network (WAN), and/or a public network (e.g., the Internet) via network adapter 20. As depicted, network adapter 20 communicates with the other components of computer system/server 12 via bus 18. It should be understood that although not shown, other hardware and/or software components could be used in conjunction with computer system/server 12. Examples, include, but are not limited to: microcode, device drivers, redundant processing units, and external disk drive arrays, RAID systems, tape drives, and data archival storage systems, etc.

Thus, one or more embodiments can make use of software running on a general purpose computer or workstation. With reference to FIG. 6, such an implementation might employ, for example, a processor 16, a memory 28, and an input/output interface 22 to a display 24 and external device(s) 14 such as a keyboard, a pointing device, or the like. The term "processor" as used herein is intended to include any processing device, such as, for example, one that includes a CPU (central processing unit) and/or other forms of processing circuitry. Further, the term "processor" may refer to more than one individual processor. The term "memory" is intended to include memory associated with a processor or CPU, such as, for example, RAM (random access memory) 30, ROM (read only memory), a fixed memory device (for example, hard drive 34), a removable memory device (for example, diskette), a flash memory and the like. In addition, the phrase "input/output interface" as used herein, is intended to contemplate an interface to, for example, one or more mechanisms for inputting data to the processing unit (for example, mouse), and one or more mechanisms for providing results associated with the processing unit (for example, printer). The processor 16, memory 28, and input/output interface 22 can be interconnected, for example, via bus 18 as part of a data processing unit 12. Suitable interconnections, for example via bus 18, can also be provided to a network interface 20, such as a network card, which can be provided to interface with a computer network, and to a media interface, such as a diskette or CD-ROM drive, which can be provided to interface with suitable media.

Accordingly, computer software including instructions or code for performing the methodologies of the invention, as described herein, may be stored in one or more of the associated memory devices (for example, ROM, fixed or removable memory) and, when ready to be utilized, loaded in part or in whole (for example, into RAM) and implemented by a CPU. Such software could include, but is not limited to, firmware, resident software, microcode, and the like.

A data processing system suitable for storing and/or executing program code will include at least one processor 16 coupled directly or indirectly to memory elements 28 through a system bus 18. The memory elements can include local memory employed during actual implementation of the program code, bulk storage, and cache memories 32 which provide temporary storage of at least some program code in order to reduce the number of times code must be retrieved from bulk storage during implementation.

Input/output or I/O devices (including but not limited to keyboards, displays, pointing devices, and the like) can be coupled to the system either directly or through intervening I/O controllers.

Network adapters 20 may also be coupled to the system to enable the data processing system to become coupled to other data processing systems or remote printers or storage devices through intervening private or public networks. Modems, cable modem and Ethernet cards are just a few of the currently available types of network adapters.

As used herein, including the claims, a "server" includes a physical data processing system (for example, system 12 as shown in FIG. 6) running a server program. It will be understood that such a physical server may or may not include a display and keyboard.

One or more embodiments can be at least partially implemented in the context of a cloud or virtual machine environment, although this is exemplary and non-limiting. Reference is made back to FIGS. 1-2 and accompanying text.

It should be noted that any of the methods described herein can include an additional step of providing a system comprising distinct software modules embodied on a computer readable storage medium; the modules can include, for example, any or all of the appropriate elements depicted in the block diagrams and/or described herein; by way of example and not limitation, any one, some or all of the modules/blocks and or sub-modules/sub-blocks described. The method steps can then be carried out using the distinct software modules and/or sub-modules of the system, as described above, executing on one or more hardware processors such as 16. Further, a computer program product can include a computer-readable storage medium with code adapted to be implemented to carry out one or more method steps described herein, including the provision of the system with the distinct software modules.

One example of user interface that could be employed in some cases is hypertext markup language (HTML) code served out by a server or the like, to a browser of a computing device of a user. The HTML is parsed by the browser on the user's computing device to create a graphical user interface (GUI).

Exemplary System and Article of Manufacture Details

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method comprising:

training a model of an audio neural network to generate a multichannel audio object comprising a greater number of audio channels than a number of given baseline audio tracks using a plurality of training inputs, the training inputs comprising one or more training features of an image extracted from one or more training video frames, two or more audio tracks corresponding to the training video frames, and one or more baseline audio tracks corresponding to the training video frames, the baseline audio tracks corresponding to the training video frames comprising a smaller number of audio tracks than the two or more audio tracks corresponding to the training video frames;

identifying one or more features in a given video frame using one or more image analysis neural networks; and generating the multichannel audio object based on the one or more identified features and the one or more given baseline audio tracks using the audio neural network, the multichannel audio object comprising the greater number of audio channels than the number of the given baseline audio tracks.

2. The method of claim 1, wherein the model comprises one of a generative adversarial network and a variational autoencoder.

3. The method of claim 1, further comprising training each image analysis neural network based on one or more neural network training video frames and one or more corresponding neural network training features.

4. The method of claim 1, further comprising down-sampling the two or more audio tracks to generate the baseline audio tracks.

5. The method of claim 1, further comprising identifying one or more objects in the given video frame, the one or more identifications being provided as input to the audio neural network.

6. An apparatus comprising:

a memory; and at least one processor, coupled to said memory, and operative to perform operations comprising:

training a model of an audio neural network to generate a multichannel audio object comprising a greater number of audio channels than a number of given baseline audio tracks using a plurality of training inputs, the training inputs comprising one or more training features of an image extracted from one or more training video frames, two or more audio tracks corresponding to the training video frames, and one or more baseline audio tracks corresponding to the training video frames, the baseline audio tracks corresponding to the training video frames comprising a smaller number of audio tracks than the two or more audio tracks corresponding to the training video frames;

identifying one or more features in a given video frame using one or more image analysis neural networks; and generating the multichannel audio object based on the one or more identified features and the one or more given baseline audio tracks using the audio neural network, the multichannel audio object comprising the greater number of audio channels than the number of the given baseline audio tracks.

7. The apparatus of claim 6, wherein the model comprises one of a generative adversarial network and a variational autoencoder.

8. The apparatus of claim 6, the operations further comprising training each image analysis neural network based on one or more neural network training video frames and one or more corresponding neural network training features.

9. The apparatus of claim 6, the operations further comprising down-sampling the two or more audio tracks to generate the baseline audio tracks.

10. The apparatus of claim 6, the operations further comprising identifying one or more objects in the given video frame, the one or more identifications being provided as input to the audio neural network.

11. A non-transitory computer readable medium comprising computer executable instructions which when executed by a computer cause the computer to perform the operations comprising:

training a model of an audio neural network to generate a multichannel audio object comprising a greater number of audio channels than a number of given baseline audio tracks using a plurality of training inputs, the training inputs comprising one or more training features of an image extracted from one or more training video frames, two or more audio tracks corresponding to the training video frames, and one or more baseline audio tracks corresponding to the training video frames, the baseline audio tracks corresponding to the training video frames comprising a smaller number of audio tracks than the two or more audio tracks corresponding to the training video frames;

identifying one or more features in a given video frame using one or more image analysis neural networks; and generating the multichannel audio object based on the one or more identified features and the one or more given baseline audio tracks using the audio neural network, the multichannel audio object comprising the greater number of audio channels than the number of the given baseline audio tracks.

12. The non-transitory computer readable medium of claim 11, wherein the model comprises one of a generative adversarial network and a variational autoencoder.

13. The non-transitory computer readable medium of claim 11, the operations further comprising training each image analysis neural network based on one or more neural network training video frames and one or more corresponding neural network training features.

14. The non-transitory computer readable medium of claim 11, the operations further comprising identifying one or more objects in the given video frame, the one or more identifications being provided as input to the audio neural network.

15. The method of claim 1, wherein the identifying the one or more features in the given video frame further comprises identifying one or more objects in the given video frame and identifying one or more spatial features in the given video frame, and wherein the generating the multichannel audio object is based on the one or more object identifications and the one or more spatial features.

16. The apparatus of claim 6, wherein the identifying the one or more features in the given video frame further comprises identifying one or more objects in the given video frame and identifying one or more spatial features in the given video frame, and wherein the generating the multichannel audio object is based on the one or more object identifications and the one or more spatial features.

17. The non-transitory computer readable medium of claim 11, wherein the identifying the one or more features in the given video frame further comprises identifying one or more objects in the given video frame and identifying one or more spatial features in the given video frame, and wherein the generating the multichannel audio object is based on the one or more object identifications and the one or more spatial features.

* * * * *